US005771707A

United States Patent [19]

Lagacéet al.

[11] Patent Number: 5,771,707

[45] Date of Patent: Jun. 30, 1998

[54] UNITARY HEAT EXCHANGER FOR THE AIR-TO-AIR TRANSFER OF WATER VAPOR AND SENSIBLE HEAT

[75] Inventors: Frédéric Lagacé, Drummondville; Daniel Forest, St-Charles de Drummond, both of Canada

[73] Assignee: Venmar Ventilation Inc., Drummondville, Canada

[21] Appl. No.: 786,130

[22] Filed: Jan. 17, 1997

[30] Foreign Application Priority Data

Jan. 16, 1997 [CA] Canada ..... 2195282

[51] Int. Cl.[6] ..... F28D 11/02; F24F 7/08

[52] U.S. Cl. ..... 62/271; 62/94; 165/8

[58] Field of Search ..... 62/93, 94, 271; 165/7, 8, 4

[56] References Cited

U.S. PATENT DOCUMENTS

| | | | |
|---|---|---|---|
| 4,093,435 | 6/1978 | Marron et al. | 55/269 |
| 4,497,361 | 2/1985 | Hajicek | 165/7 |
| 4,574,872 | 3/1986 | Yano et al. | 165/8 |
| 4,678,643 | 7/1987 | Fetzer | 422/175 |
| 5,526,651 | 6/1996 | Worek et al. | 62/271 |

FOREIGN PATENT DOCUMENTS

| | | | |
|---|---|---|---|
| 161694 | 9/1984 | Japan | 165/8 |

*Primary Examiner*—William Doerrler
*Attorney, Agent, or Firm*—Ronald S. Kosie; Robert Brouillette

[57] ABSTRACT

A unitary heat exchanger device, for the transfer of total heat, comprising air-to-air heat transfer means and configured such that air may pass there through. The heat transfer means comprises an air-to-air water vapor transfer element and an air-to-air sensible heat transfer element, the exchanger elements being in air communication with each other. The device may be used in ventilation systems which replace air exhausted from the interior of a building with fresh outside air; the use of the device under cold weather conditions may avoid or attenuate the need for using a defrost mechanism to defrost the device.

5 Claims, 8 Drawing Sheets

UNITARY HEAT EXCHANGER FOR THE AIR-TO-AIR TRANSFER OF WATER VAPOR AND SENSIBLE HEAT

BACKGROUND OF THE INVENTION

The present invention relates to a unitary heat exchanger device for the air-to-air transfer of total heat (i.e. latent and sensible heat).

A known type of exchanger device is the rotary heat exchange wheel. Such (air-to-air) exchanger wheels may have an air permeable heat exchange body which provides passageways therethrough through which an air stream may flow. The exchanger body may, for example, comprise a plurality of parallel flow channels (see for example U.S. Pat. No. 4,769,053) or even a random body media (see for example U.S. Pat. No. 5,238,052). Such exchangers have been configured and disposed such that as they rotate they may transfer heat, between two or more streams of air through which the exchangers rotationally pass through. Such rotary heat exchangers (i.e. for air-to-air transfer of latent/sensible heat) may be disposed in a housing which is suitably baffled such that a rotating exchanger wheel may pass through the fresh air and exhaust air streams with minimal intermixing thereof. Such wheels thus may form part of a heat recovery ventilation system or apparatus which functions to draw fresh exterior air into a sheltered space such as building, a room and the like, and to exhaust stale interior air to the outside. Such systems are of course provided with appropriate ducting, channels and the like which define a fresh air path and an exhaust air path whereby for example interior air of a building may be exchanged with exterior ambient air; e.g. during ventilation the air in one path may not normally be allowed to mix with the air in the other path.

Energy conservation is of continuing concern in the design of air ventilation systems, apparatuses and the like. There is thus a continuing need for alternate heat exchanger devices which may be used to recover not only sensible heat but also humidity (i.e. water moisture) from a given air stream and transfer said heat and humidity to another air stream.

It is known for example to use two separate heat exchanger wheels in a ventilation apparatus in order to recover latent and sensible heat, i.e. to use a separate latent heat wheel (L-wheel) and a separate sensible heat wheel (S-wheel). The L-wheel is sometimes described as a desiccant or hygroscopic wheel. As may be surmised an L-wheel may be used to transfer moisture between air streams, i.e. an L-wheel is a moisture transfer wheel. A number of such two wheel air ventilation or conditioning apparatuses or systems are for example described in U.S. Pat. 5,373,704 (McFadden), 3,844,737 (Macriss et al) 4,180,126 (Rush et al), 4,729,744 (Cohen et al) and 3,144,901 (Meek).

In addition, to the need for two separate wheels, the systems and apparatuses described in the above mentioned patents also require that a heat source be disposed between the two wheels in the air stream path used by air moving from the S-wheel to the L-wheel, i.e. in order to heat air leaving the S-wheel before it is passed through the L-wheel. In this case the heat source is essential in order to regenerate the L-wheel. The heat source can take any suitable form e.g. an open flame, a hot water heat exchanger and the like.

Air ventilation or conditioning systems which not only exploit two separate exchanger wheels but also a heat source intermediate the wheels may as a consequence be relatively complex and relatively expensive to operate. The presence of a heat source may require that the system be provided with fire safety and control devices (e.g. a water sprinkler system). The use of an open flame, in particular, may require the need for safety and control systems which naturally increase the level of complexity of the system or apparatus. This increases the cost of manufacturing of such systems and also adds to the maintenance and upkeep costs. In any event the fuel or other energy source for the heat means represents an additional operational cost which must also be factored into the cost of running such an installation.

Air ventilation systems or apparatus are, in particular, used under cold or winter conditions to expel or exhaust interior air to the outside of an enclosure (e.g. building or room thereof) while introducing fresh air from the outside (i.e. outside ambient air). A problem with ventilation equipment used to extract heat from exhaust air, is the production of frost or ice in the exhaust path of the system During cold weather, prior to expelling the relatively warm exhaust air, the equipment provides for the transfer of heat from the relatively warm exhaust air to the relatively cool (fresh) outside air by the use of a suitable heat exchange element. However, since the warm interior air will usually contain a certain amount of moisture, the cooling of the interior air can result in the formation not only of water condensate but of ice if the exterior air is below the freezing point of water. An uncontrolled buildup of ice on the exhaust air side of a heat exchanger device can result in decreased heat transfer, and even outright blockage of the exhaust air path. Accordingly, it is known to provide a means of periodically defrosting such a heat exchanger device in order to maintain it's efficiency (see for example U.S. Pat. No. 5,193,610). The provision of such a defrost mechanism can also add to the cost of manufacturing an air ventilation apparatus as well as to its operation and maintenance; the defrost mechanism also adds another level of complexity to the apparatus. The periodic defrosting also interrupts the ventilation function, i.e. there is no continuous ventilation function.

A further winter problem revolves around the fact that the cold winter air is usually drier than the air inside a structure such as a residence or other type of building or enclosure in which people may be active. Accordingly, if interior air is expelled without any means being provided for recovering the moisture therefrom, a humidifier component may be required (either as part of the ventilation apparatus or as a stand alone unit) for adding moisture to the fresh exterior air in order to maintain a comfortable humidity in the enclosure. The provision of a humidificator adds to the cost and complexity of an air ventilation system.

Accordingly, it would be advantageous to have a single heat exchanger device which could be used to recover moisture from one air stream and transfer the moisture to another air stream. In this respect it would for example be advantageous to have a means for preheating cold dry air prior to humidifying it for subsequent delivery into an enclosure. It would also be advantageous to have a single heat exchanger device which may be able to operate at low outside ambient air temperature below the saturation curve of water in air.

It would also be advantageous to have a single heat exchange device which would be able to carry out the functions of transferring moisture and sensible heat from one air stream to another air stream e.g. transferring moisture and sensible heat from exhaust to fresh air.

It would in particular be advantageous to have a single heat exchange wheel which would be able to separately carry out the function of transferring moisture from one air stream to another air stream and separately carry out the function of transferring sensible heat from one air stream to another air stream.

It would also be advantageous to have a means whereby an intermediate heat source may be avoided.

It would further be advantageous to have heat exchange means which would allow for a continuous ventilation function even during cold weather.

It would also be advantageous to have an heat exchange element which may be easily removed and installed.

It would also be advantageous to provide an heat exchange means whereby an air exchange system may be relatively simplified so as to reduce the number of overall steps required to effect the air-to-air exchange and so as to reduce the level of complexity of the exchange system with the accompanying reduction in manufacturing and maintenance costs.

SUMMARY OF THE INVENTION

The present invention in accordance with a general aspect provides a unitary air-to-air heat exchanger device whereby air may pass through an air permeable air-to-air water vapor (i.e. moisture) transfer element and an air permeable air-to-air sensible heat transfer element.

Thus, the present invention generally provides a unitary air-to-air heat exchanger device comprising an air-to-air water vapor transfer element and an air-to-air sensible heat transfer element, said transfer elements being configured such that air may pass there through, said water vapor transfer element being configured for the capture and release of water vapor from and to air and said sensible heat transfer element being configured for the capture and release of sensible heat from and to air.

As may be appreciated from the above, an exchanger device of the present invention comprises at least two distinct (i.e. individual or separate) transfer elements which form part of a single (i.e. unitary) heat exchanger device; one of said at least two transfer elements is a latent or hygroscopic transfer element (i.e. an L-element), and the other transfer element is a sensible heat transfer element (i.e. an S-element). The unitary exchanger device may comprise three or more of such transfer elements disposed so as to be in alternating disposition. A pair of exchanger elements may, for example, if desired, be spaced apart by an intermediate air permeable element(s) which is of a heat insulating or non-hygroscopic material; this intermediate element(s) will thus not have an air-to-air moisture/heat transfer capacity.

In accordance with the present invention, the basic (i.e. essential) function of the moisture transfer element (i.e. the L-element) is air-to-air transfer of water vapor (i.e. moisture).

Similarly, the basic (i.e. essential) function of the sensible heat transfer element (i.e. the S-element) is air-to-air transfer of sensible heat. Such an exchanger device may be disposed (as discussed herein below), in a ventilation system such that warm moist exhaust air from a room or building may first be dried and then be cooled prior to being ejected into the outside environment whereas exterior cool dry air may first be preheated and then be humidified prior to being passed into the room or building; since the exhaust air is desiccated prior to cooling the buildup of water condensate or ice in the exchanger device may be obviated.

The exchanger device, as well as the exchanger elements thereof, may take any desired or necessary form; the exchanger elements may have the form of a sector of a cylindrical drum or wheel; alternatively, it may take on the form of a parallelepiped (e.g. rectangular) type exchange core. As described herein an exchanger device of the present invention may, for example, in particular, be in the form of a rotatable exchanger device which may, for example, be used in ventilation apparatus wherein the device may rotate through two or more separate air paths defined by suitable ducting or the like. In the case of a rotary type exchange device, for example, the transfer elements may be configured so as to capture (i.e. take-up, absorb, etc.) and release water vapor (i.e. moisture) or sensible heat from and to air. In the case of a non-rotary type exchange device, for example, the transfer elements may comprise wall means through which water moisture or sensible heat may pass between air in separate air paths.

Thus, in accordance with an aspect of the present invention there is provided a unitary air-to-air rotary heat exchanger device having a rotational axis and being configured such that air may pass there through in a direction along said rotational axis; the device comprising an air-to-air water vapor (i.e. moisture) transfer element (permeable to air) and an air-to-air sensible heat transfer element (also permeable to air).

A rotary exchange device of the present invention may be configured and be disposed in a suitable ventilation system in any suitable (known ) manner such that the device interrupts a first air path and a second separate air path. In this case, the exchanger device may be made to rotate about the rotational axis such that the device passes through the first air path and the second separate air paths. The water vapor exchange element is configured so as to be able to capture water from an air stream flowing in one of said air paths and release said so captured water to a second air stream flowing in the other air path. Similarly, the sensible heat exchange element is configured so as to be able to able to capture sensible heat from an air stream flowing in one of said air paths and release said so captured sensible heat to a second air stream flowing in the other air path.

In accordance with the present invention the water vapor transfer element and the sensible heat transfer element may each comprise channels; channels of the moisture transfer element being in air communication with channels of the sensible heat transfer element. As may be appreciated in this case the transfer elements are in air communication with each other such that air may flow through channels of one transfer element to and through channels of the other transfer element. The channels may be straight, bent or winding; the channels of one transfer element may be coaxially disposed relative to the channels of the other; the channels of one transfer element may be axially offset with respect to the channels of the other. As mentioned air flow through a rotatable device may generally be in a direction along the rotational axis of the rotatable unitary exchanger device. The channels may be defined by walls which may, as the case may be, be configured either to absorb and release moisture or to absorb and release sensible heat between separate air flows as the exchanger device rotates and passes through separate air paths. Alternatively, if desired, one or more of the transfers element may be of a random body media permeable to air and capable of transferring moisture or sensible heat.

The unitary exchanger device may more particularly have the form of an air permeable wheel.

The present invention, thus, in a particular aspect provides a unitary air-to-air heat exchanger wheel having a rotational axis and comprising a first air-to-air water vapor transfer wheel segment and a second air-to-air sensible heat transfer wheel segment, said first and second wheel segments each having an axis of rotation coaxial with said rotational axis, said wheel segments being in air communication with each other and being configured such that air may pass there through in a direction along said rotational axis, said water vapor transfer wheel segment being configured for the capture and release of water vapor from and to air, and said sensible heat transfer wheel segment being configured for the capture and release of sensible heat from and to air.

In accordance with the present invention the first and second wheel segments may for example be configured and disposed such that the wheel may be rotated about the rotational axis and such that first and second separate air streams are made to flow through the wheel in opposite directions (i.e. counterflow). In this case, the first stream may initially enter the first wheel segment and the second air stream may initially enter the second wheel segment. The water vapor transfer wheel segment may be configured so as to be capable of capturing (e.g. absorbing) water vapor (i.e. moisture) from the first air stream and releasing said water moisture into the preheated second air stream flowing from the second wheel segment to the first wheel segment. The sensible heat transfer wheel segment may be configured so as to be capable of capturing (e.g. absorbing) sensible heat from the dehumidified first air stream flowing from the first wheel segment and releasing sensible heat into the second air stream flowing through the second wheel segment.

In accordance with the present invention a heat exchanger wheel may have at least a first wheel segment and a second wheel segment that abut or are adjacent to each other;. Alternatively, a heat exchanger wheel may have first and second wheel segments that are spaced apart by an intermediate air permeable wheel segment which is of a heat insulating material (i.e. the central intermediate segment sandwiched between the two outer segments does not provide a heat transfer capability to the wheel). A heat exchanger wheel of the present invention may, in addition to the first and second wheel segments, have one or more other wheel segments having a moisture or sensible heat transfer capability (e.g. an exchanger wheel may have three wheel segments comprising two outer sensible heat transfer segments and inner moisture transfer wheel segment sandwiched there between or vis versa). A heat exchanger wheel may have only two wheel segments, i.e. the wheel may consist of a first air-to-air, water vapor transfer wheel segment and a second, air-to-air, sensible heat transfer wheel segment,.

A water vapor transfer wheel segment and the sensible heat transfer wheel segment may each comprise channels, as mentioned above; channels of the water vapor transfer element being in air communication with channels of the sensible heat transfer element. The channels of the water vapor transfer whel segment and the sensible heat transfer wheel segment may be disposed in any desired fashion as long as air may flow thorough the heat transfer device in a direction along the rotational axis,e.g. the channels of the transfer elements may be disposed so as to be more or less parallel to the rotational axis. Alternatively, if desired, one or more of the transfers element may be of a random body media permeable to air (see above).

In addition to a rotary form, an exchanger in accordance with the present invention may take on a form (e.g. a non-rotary form) whereby the device includes built-in separate air paths; in this case, walls separating the air separate paths may be configured in any suitable or known fashion for the transfer, between separate air flows passing through respective air paths, of moisture or sensible heat through the wall structures separating the air flows.

Thus, in accordance with another aspect, the present invention thus provides a unitary air-to-air heat exchanger device comprising separate first and second air paths configured for the passage of air there through and wall means between said first and second air paths, said wall means comprising an air-to-air water vapor transfer wall component, and an air-to-air sensible heat transfer wall component, said water vapor transfer wall component defining a respective portion of said first and second air paths and being configured for the transfer there through of water vapor in air in said first air path to air in the second air path, said sensible heat transfer wall component defining a respective portion of said first and second air paths and being configured for the transfer there through of sensible heat in air in said first air path to air in the second air path.

In accordance with the present invention, the first and second air paths may, for example, each comprise a single channel. On the other hand, one of the air paths may comprise a single channel while the other air path may comprise a pair of channels disposed such that they are spaced apart by the single channel of the other air path (i.e. sandwich fashion). Alternatively, each of the first and second air paths may, for example, comprise a plurality of separate channels defined by the wall means; these channels may be staggered such that each channel of the first air path is spaced apart by a channel of the second air path.

An exchanger device having separate first and second air paths may for example take on a box-like form, e.g. a parallelepiped form. This type of device may be provided with one or more (e.g. a plurality of) first channel members defining one air path and one or more (e.g. a plurality) of second channel members defining a second separate air path. Each of these air paths may have its own inlet and outlet means. If the device has a plurality of first and second channel members these may be disposed in alternating fashion as described below.

A unitary heat exchanger device, in accordance with the present invention, may be incorporated into an air ventilator in any known fashion for air-to-air moisture/heat transfer. For example, it may be disposed so as to define part of an exhaust air stream path and a fresh air stream path for a ventilation system which vents exhaust air to the outside of a structure and brings fresh air outside air into the structure. In any case a heat transfer device would be appropriately connected to air ducting, fan means, etc, such that the device may operate to transfer moisture and heat from a warm exhaust air stream to a cool fresh air stream such that the fresh air stream may be preheated and then humidified with the heat and humidity recovered from the exhaust air stream.

As mentioned above an heat exchanger device of the present invention comprises at least two transfer bodies which form part of a single heat exchanger device; one of said at least two bodies is a latent or hygroscopic transfer element (i.e. L-element, e.g. L-wheel), and the other is a sensible heat transfer element (i.e. S-element, e.g. S-wheel).

In accordance with the present invention, the heat exchanger device may, for example, be built up from at least two separate transfer elements, one of which comprises a respective water vapor transfer element and the other a respective sensible heat transfer element.

The separate transfer elements may be joined or connected together in any suitable or desired manner such that they are in immediate contact with one another. The connection may be releasable or permanent. Advantageously, the transfer elements may be releasably connected together so as to allow for the separation of the elements from one another for cleaning, repair, or replacement, amongst other reasons. The separate transfer elements may, however, be more or less permanently fixed together as for example, by being glued together at their interface by an adhesive. The separate transfer elements may alternatively be provided with peripheral flange members which may be disposed so as to line up respective openings therein for engaging the stem of a screw or a bolt such that the segments may be clamped together.

A pair of L-and S-transfer elements may, if desired, be spaced apart by and connected to an intermediate air permeable segment which is of a heat insulating material; this intermediate segment which indirectly connects the segments together is thus not intended to participate in the air-to-air transfer of moisture or sensible heat.

In any event, the abovementioned separate transfer elements for a rotary device are of course to be connected together such that the bodies of the element are in air communication with each other such that an air stream may flow from the one element to the other, i.e. so that air may flow through the heat transfer device.

The proportion of the overall size of an exchanger device (i.e. rotary or non-rotary) which is dedicated to moisture transfer and to sensible heat transfer may vary as desired; the proportion may be half and half or some other suitable or desired proportion. Thus, if, for example, an exchanger device comprises a heat transfer means which consists of two transfer elements, the hygroscopic element and the sensible heat element may each represent 50% of the transfer means. However, it is to be understood that the proportion of the exchanger wheel represented by the hygroscopic segment and by the sensible heat segment may, be different; the respective proportions may, for example, vary from 25 to 75% of the overall size of the heat exchanger wheel.

If a unitary exchanger device is of a rotary type it may be provided with axle means about which the device may rotate.

A rotary heat exchanger device may, for example, be made from a rectangular substrate (e.g. sheet) of suitable thickness and having a corrugated cross section; the substrate being capable of being rolled up to form a wheel exchanger having channels more or less parallel to an axis of rotation. The substrate may be of a material having a capacity for capturing and releasing sensible heat. A rectangular half section of the corrugated sheet may be coated with a suitable desiccant material on one or both sides thereof, the coating(s) being applied such that the corrugations of the sheet are covered with the desiccant material over only one half of their length. A corrugated aluminum sheet may for example be so treated so as to have a desiccant coated rectangular part and an non-coated rectangular part. A desiccant or hygroscopic coating may be deposited or applied in any suitable (known) manner. The hygroscopic section of the sheet may comprise a coating of any suitable material or substance that may have the desired effect of releasably removing moisture from air; a suitable desiccant material may, for example comprise silica gel, a zeolite, lithium chloride, a polymeric desiccant, etc. A so coated substrate (e.g. sheet) may then be rolled up about a connecting or support rod with the corrugations disposed parallel to the longitudinal axis of the rod such that a one half of the rolled up substrate defines a moisture transfer wheel segment and the other half a sensible heat transfer wheel segment, the segments comprising moisture/heat transfer apertures or channels disposed parallel to the longitudinal axis of the rod. The connecting rod may serve to define a support member which may be configured to engage a bearing member such that the wheel may rotate thereabout, i.e. the obtained exchanger wheel has a rotational axis which is coincident with the longitudinally axis of the rod.

In accordance with the present invention a wheel segment may have a disk like form or a thicker cylindrical form. The wheel segments may for example be of identical shape or form with respect to one another or be of different shape or form. The wheel segments may, for example have the same diameter or the diameters may be different.

As mentioned above a heat exchanger wheel may be made up from separate wheel segments.

The separate wheel segments may comprise known exchanger wheels which are suitably attached together so as to be able to rotate about a rotational axis; alternatively an exchange wheel may comprise a known wheel part and a wheel part rolled up from a sheet material as described above. The known wheel part may for example be of the L-wheel type; the rolled up part may comprise a rolled up sheet of corrugated material without any hygroscopic coating;

the sheet being of a material such that the rolled up part may function as a sensible heat transfer segment (e.g. a sheet of aluminum, copper, plastic, composite, etc.).

A rotary unitary heat exchanger device of the present invention may be incorporated in any suitable (known) fashion into an air ventilation apparatus.

A rotary device may for example be incorporated into a ventilation system in a manner which is the same as or analogous to that for the incorporation of a known thermal wheel for rotation about its rotational axis. A rotary unitary heat exchanger device of the present invention may thus be incorporated into an air ventilation apparatus or system in a manner such that the device on the one hand defines part of and is able to rotate through an exhaust air path and on the other defines part of and is able to rotate through a fresh air path. The driving means which induces rotational movement of the heat exchanger device may, for example, comprise a electric drive motor directly or indirectly connected to an axle member of the rotary exchanger device; the driving means may comprise a drive belt wrapped about the periphery of the device, the belt being connected to an electric motor; any other desired or required driving means may of course be used to achieve the desired rotation of the device. The rotary heat exchanger device (e.g. wheel) may, for example, be supported through an above mentioned axle member on bearing means or any other desired or required friction reducing means which may facilitate the rotation of device.

An exchanger device of the present invention provided with built-in separate air paths (i.e. a non-rotary device), may have a plurality of partition wall members between the separate air paths; each of the partition wall members may be divided into a water vapor (i.e. moisture) transfer segment and a sensible heat transfer segment. The water vapor transfer segment may for example be of a suitable water vapor permeable material (e.g. paper) and the sensible heat transfer segment may be of a suitable material (e.g. a plastics material, a metal, e.g aluminum, copper, etc.) capable of allowing heat to be passed therethrough from one air stream to another air stream. The water vapor transfer segments may be disposed opposite each other so as to define a water vapor transfer wall component and the sensible heat transfer segments may also be disposed opposite each other so as to define a sensible heat transfer wall component as described for example below.

An exchanger device of the present invention provided with built-in separate air paths may be incorporated into ventilation systems in the same or analogous fashion as for example for known non-rotary heat transfer cores.

A ventilation apparatus comprising a unitary exchanger device of the present invention may be provided with suitably ducting so as to pass exhaust air initially through the L-element of the unitary device and then through the S-element while at the same time initially passing fresh cool air through the S-element and then through the L-element of the heat exchanger device. In this manner, the humidity in the exhaust air may be reduced by the L-element before the exhaust air encounters the cooler S-element. This configuration may not only inhibit frosting up of the S-element at relatively low exterior ambient air temperatures but also facilitates the return of humidity back to the warm interior of an enclosed space being serviced by the air ventilator, i.e. the need for a deicing mechanism may in this manner be eliminated or reduced. The fresh air and the exhaust air may be induced to pass through the unitary exchanger device through the use of suitable air driving means, such as by fan means which is able induce a forced air flow, due to positive air pressure or negative air pressure.

In accordance with the present invention moisture and heat transfer occurs in the absence of an intermediate heat source as required by the above described known ventilation systems. As a result, if the device of the present invention is of a rotary type the latent side may not be regenerated at a high efficiency level. This may be attenuated or compensated for by causing the heat exchanger device to rotate at an RPM which provides a desired moisture transfer. The unitary heat exchanger device may for example be made to rotate at a rotational speed of from 10 to 30 RPM. It is understood however that if required or desired, the rotational speed of the air exchanger wheel may be lower than 10 RPM or higher than 30 RPM to suit the desired or necessary operational requirements.

In the drawings which illustrate example embodiments of the invention:

Figure 1:
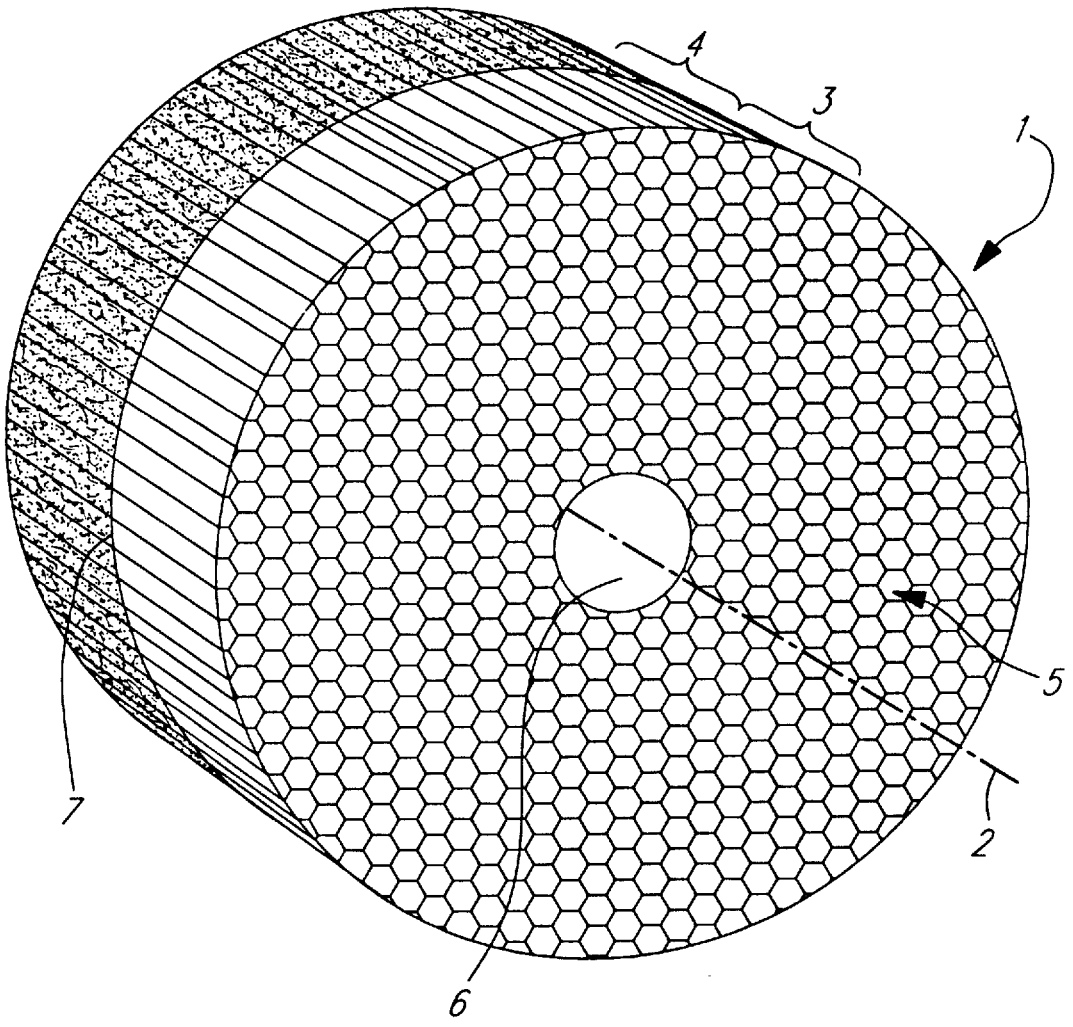
FIG. 1 is a schematic perspective view of an example embodiment of an exchanger wheel in accordance with the present invention comprising two wheel segments.
Figure 2:
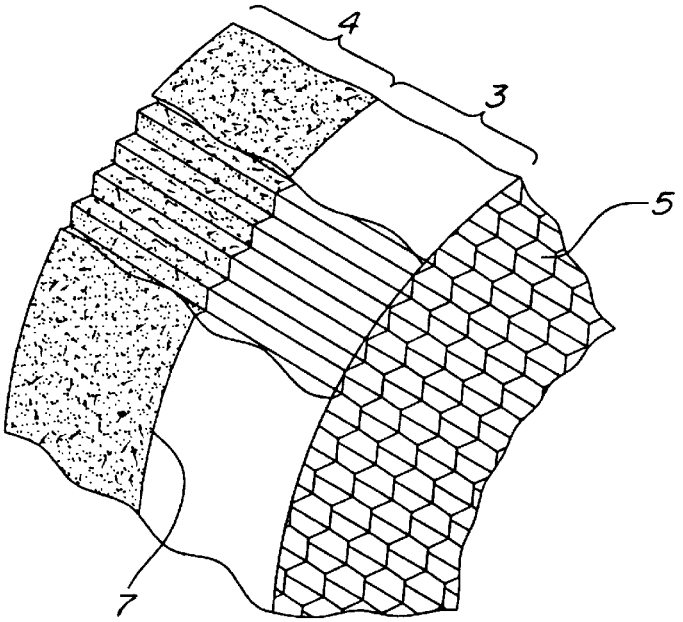
FIG. 2 is a partially cut away schematic perspective view of the example embodiment of the exchanger wheel shown in FIG. 1.

Turning now to FIGS. 1 and 2, there is shown an example embodiment, in accordance with the present invention, of a unitary heat exchanger device in the form of an air permeable unitary heat exchanger wheel 1. The wheel 1 has an overall cylindrical drum like configuration. The heat exchanger wheel 1 could of course, if desired or if necessary, have a different overall configuration. The wheel 1 has a rotational axis 2 about which the wheel 1 may be made to rotate.

The heat exchanger wheel 1 has two essentially equally sized wheel segments, namely a sensible heat wheel segment 3 and a latent wheel segment 4. Each of the segments 3 and 4 has a honeycomb like structure. The segments 3 and 4 each have an axis of rotation which is coaxial with the rotational axis 2 of the wheel 1. As may be appreciated, the segments each comprise a plurality of open ended channels of hexagonal cross section; one of the channels of the sensible heat wheel segment 3 is designated with the reference numeral 5 in FIGS. 1 and 2. Wheel segment 3 and/or segment 4 may of course have channels which are of a different cross sectional shape (e.g. circular, square etc.) The channels of the wheel segments 3 and 4 are in air communication with each other so as to enable the free flow of air from one segment to the other. In the embodiment shown the hexagonal channels of the wheel segment 3 are each coaxially aligned (i.e. are in line) with a respective hexagonal channel of the wheel segment 4; the channels are also more or less parallel to the rotational axis 2 of the exchanger wheel 1. The channels of a wheel segment may if desired not be coaxially aligned with the channels of the other wheel segment; i.e. channels of a wheel segment maybe axially offset relative to channels of the other wheel segment so as to provide air communication or access to two or more channels of an adjacent wheel segment. It is of course to be understood that the channels may be offset relative to each other provided that air may still pass through the wheel 1

The wheel 1 has a first air permeable face which is defined by the outer openings of the channels of the wheel segment 3 and a second permeable rear face hidden from view on the opposite side of the wheel 1 similarly defined by the outer openings of the channels of the wheel segment 4. Air may thus pass through the entire wheel 1 in a direction along the rotational axis 2, e.g. through the first face, through the body of the wheel (i.e. each of the wheel segments 3 and 4) and out through the rear face and vis-versa. The wheel 1 does not have a built-in mechanism for providing separate air paths for air flow therethrough; separate air paths and air flow therethrough may, however be provided by means of appropriately arranging ducting means about the wheel 1 in known manner.

The wheel segments 3 and 4 may be derived from separate wheel elements and may be connected directly together by adhesive means which does not interfere with the air permeability of the wheel 1. If desired the wheel segments may each alternatively be provided with a peripheral flange member (not shown) disposed at the edges thereof adjacent the seam or boundary line 7 between the wheel segments. Such flanges may be relatively short in height and may be provided with openings which may be lined up for engaging screw or bolt means for releasably attaching the wheel segments together.

These segments may be constructed in any suitable manner such as for example discussed herein so as to provide water vapor (i.e. moisture) transfer (i.e. by segment 4) and sensible heat transfer (i.e. by segment 3). Thus the channels of segment 4 may be defined by wall members which have inner surfaces covered with a suitable desiccant; the wall members defining the segment 3 may be of a suitable material (e.g. metal) which may be able to absorb and release sensible heat to air.

The air exchanger wheel 1 has a central opening 6 disposed about the axis 2 of the air exchanger wheel 1. The central opening 6 may be configured for receiving a shaft or other form of axle means (not shown) for rotational support of the wheel 1 in an air ventilation apparatus. The shaft may be rotationally engaged in the opening 6 such that if the shaft is fixed to a support member of the air ventilation apparatus the wheel 1 may be made to rotate thereabout. Alternatively the shaft may be fixedly engaged in the opening 6; in this case the shaft is rotatably engaged with the air ventilator support member so as to facilitate rotation of the wheel and the shaft together.

Figure 3:
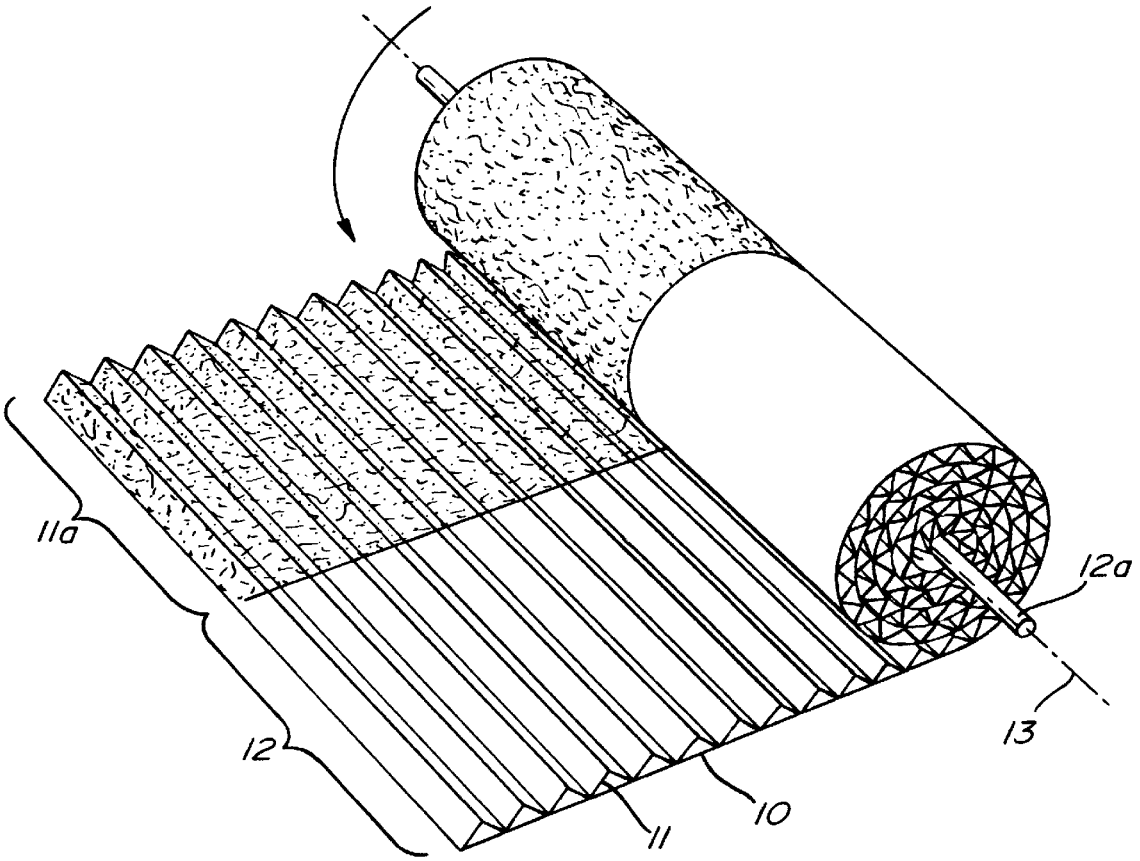
FIG. 3 is a schematic perspective view of a rotary exchanger device in the process of being formed from a corrugated sheet.

FIG. 3 illustrates another example embodiment of a rotary exchanger device in accordance with the present invention. As shown the device is built or rolled up from a sheet component comprising a more or less flat sheet member 10 and a corrugated sheet member 11 attached (e.g. glued) to the flat sheet member 10; the sheet members 10 and 11 may each be of a suitable plastics substrate (e.g. of polypropylene) paper and/or a suitable metallic substrate such as of aluminum, copper, etc. The sheet component has a first rectangular part 11*a* and a second rectangular part 12. The first part 11*a* has a desiccant coating applied on both sides thereof, i.e. a suitable water capturing coating is applied in any suitable fashion on the outer surfaces of each of the sheet members 10 and 11. No such desiccant coating is applied to the outer surfaces of the second part 12.

The sheet component is rolled up in any suitable fashion around a support rod 12*a*. The support rod 12*a* has a longitudinal (e.g. rotational) axis 13. As may be seen from FIG. 3, the sheet component is disposed relative to the rod 12*a* so that the corrugations of the sheet member 11 are more or less parallel to the axis 13 of the rod 12*a*. As may be appreciated as the sheet component is rolled up the sheet member 11 will be contact the sheet member 10 so as to define channels which will be more or less parallel to the axis 13.

Figure 4:
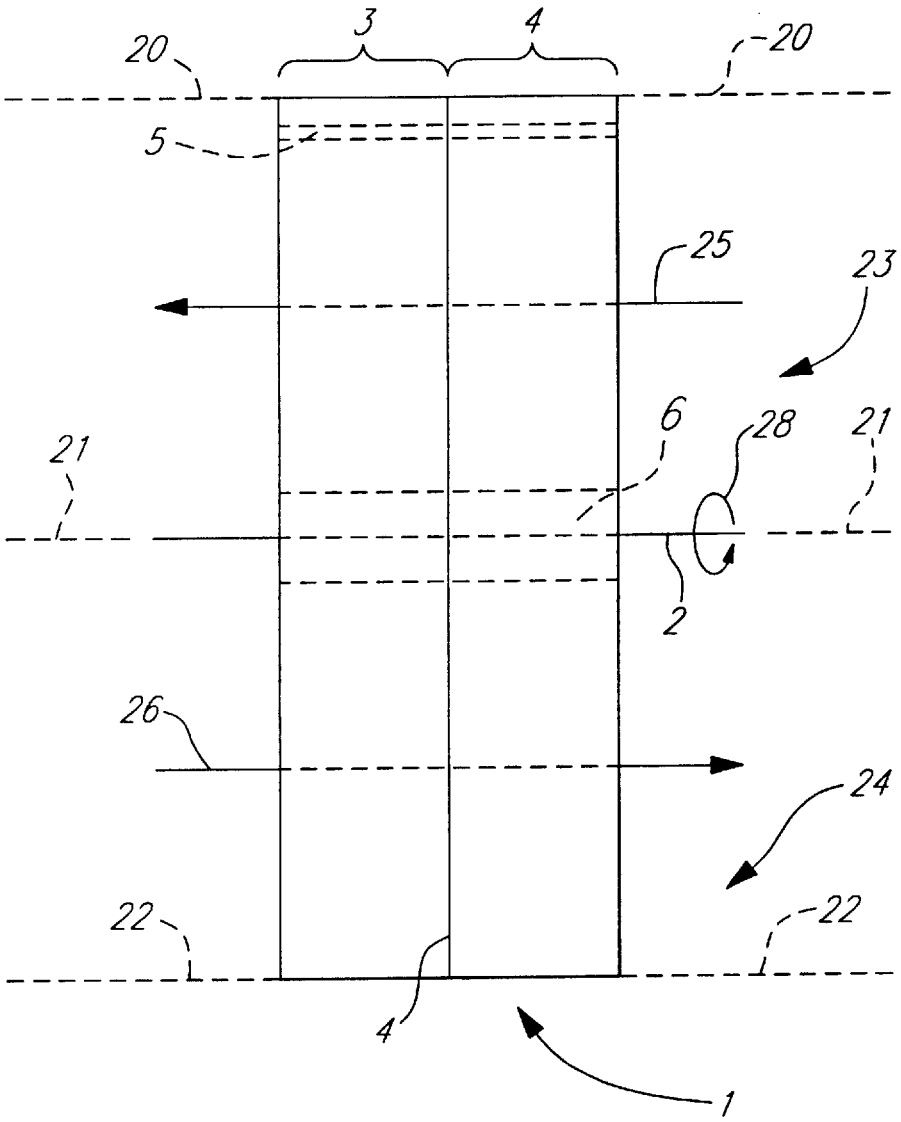
FIG. 4 is a schematic side elevation view of the example embodiment of the exchanger wheel shown in FIG. 1.

FIG. 4, is a schematic illustration of the wheel of FIG. 1 wherein the dotted lines 20, 21 and 22 represent wall members of a duct system of an air ventilation system, the wheel 1 being mounted therein for rotation (during a ventilation cycle) between an upper exhaust air stream path 23 defined by wall members 20 and 21 and a lower fresh air stream path 24 defined by wall members 21 and 22. The air paths as shown are essentially separate such that there is no or little mixing of air in the two air steam paths in the vicinity of the wheel 1.

Arrow 25 shows the direction of exhaust air flow first through the latent wheel segment 4 and then through the sensible heat wheel segment 3; as may be seen the air flow is in a direction along the axis 2. Arrow 26 shows the direction of fresh air flow first through the sensible heat wheel segment 3 and then through the latent wheel segment 4; again as may be seen the air flow is in a direction along the axis 2 but opposite to that in the upper exhaust air stream path.

In operation, the example embodiment of an exchanger wheel of the present invention as represented in FIG. 4 is disposed so as to transfer water vapor (i.e. moisture) and sensible heat as follows. The said exhaust air is first introduced into the latent or hygroscopic wheel segment 4 which takes up water moisture from the exhaust air flowing therethrough. The so dried exhaust air then flows into the sensible heat wheel segment 3 which takes up sensible heat from the dried exhaust air before the exhaust air passes out of wheel 1. At the same time that exhaust air is flowing through the air exchanger as described above, cold exterior fresh air is introduced into the sensible heat wheel segment 3 in the direction of the arrow 26 opposite to that of the exhaust air. Thus fresh air is initially introduced into the sensible wheel segment 3 of the air exchanger wheel where it is preheated by heat transferred from the exhaust air. After absorbing heat in the sensible segment 3, the fresh air then flows through the latent wheel segment 21 where it absorbs water vapor taken from the exhaust air. The fresh air is then, for example available for introduction into the interior of an enclosure. Heat and moisture transfer is of course accomplished while the wheel 1 is made to rotate about the axis 2 in the direction of the arrow 28.

As may be understood from the above, the exhaust air leaving the latent segment 4 has a reduced moisture content when it contacts the relatively cold part of the sensible heat wheel segment 3. As a result the risk of water condensation and ice blockage of the segment 3 may thus be attenuated without or with a reduced reliance on a deicing mechanism or system; the device may thus, for example, be used in a more or less continual ventilation mode with no stoppage for a defrost function.

Figure 5:
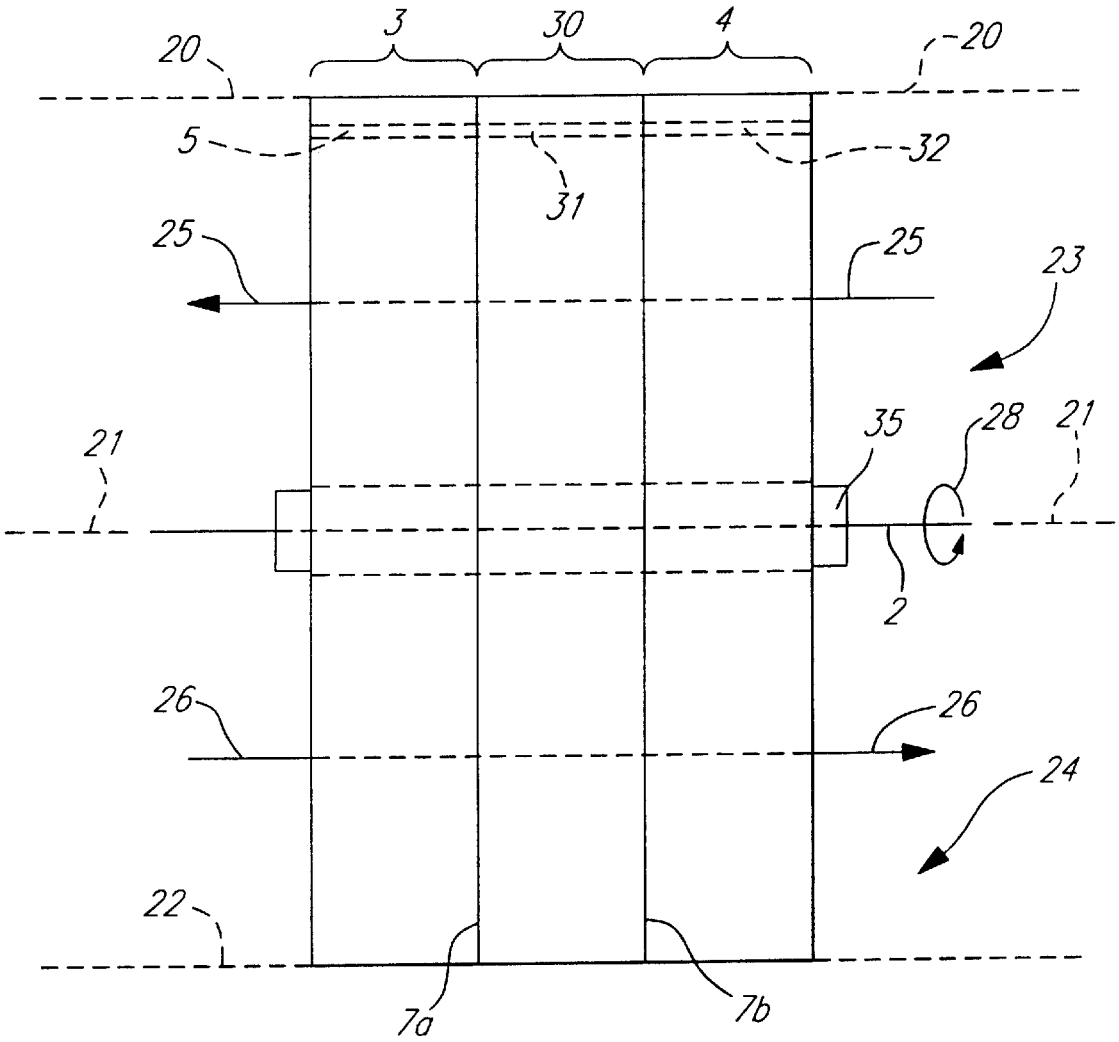
FIG. 5 is a schematic side elevation view of another example embodiment of an exchanger wheel in accordance with the present invention comprising three wheel segments.

Turning to FIG. 5 this figure illustrates a further embodiment of a rotary exchanger device in accordance with the present invention. The device of FIG. 5 is a modified version of the device shown in shown in FIGS. 1 and 4; accordingly, common elements will be designated in FIG. 5 with the same reference numerals used in FIGS. 1 and 4. The device of FIG. 5 is provided with an intermediate wheel segment 30 sandwiched between the wheel segments 3 and 4. The wheel segment 30 is provided with channels which are in line with the channels of segments 3 and 4, i.e. the various channels of the segments are in air communication with each other so that air may pass through the wheel shown in FIG. 5. One of the channels of segment 3 is designated with the numeral 5; one of the channels of segment 30 is designated with the numeral 31; one of the channels of segment 4 is designated with the numeral 32. In the version shown in FIG. 5 a support shaft or rod 35 is illustrated.

Figure 6:
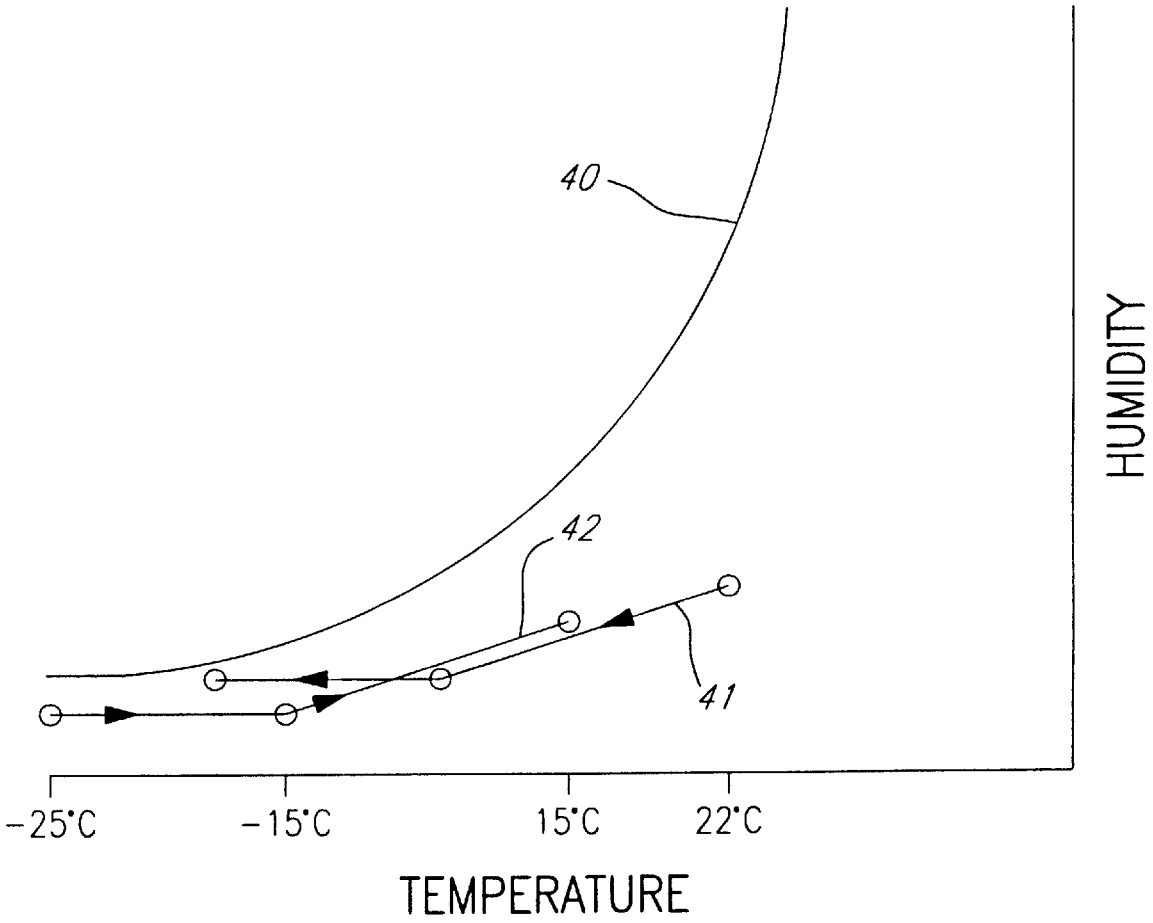
FIG. 6 is a graphic depiction of the air-water saturation curve (i.e. temperature vs humidity)

A rotary exchange device of FIG. 1 may for example be operated as follows: fresh exterior air at or near −25° C. may introduced into the sensible, non hygroscopic segment (S-wheel segment 3) of the exchanger wheel 1, where the temperature thereof may be raised to or about −15° C. through the transfer of heat thereto, with no humidity transfer. The fresh exterior air then immediately enters the hygroscopic or latent segment (L-wheel segment 4) of the exchanger wheel where it may absorb humidity and may absorb further sensible heat to obtain a temperature at or near 15° C. In turn, exhaust air is introduced into the exchanger wheel 1 in a direction opposite to that of the fresh air and from the other side of the exchanger wheel 1 into the hygroscopic segment (L- wheel segment 4) of the air exchanger wheel where the exhaust air releases humidity (and some sensible heat) into said hygroscopic segment 4. At this point, the temperature of the exhaust air may be reduced to or near −8° C. The exhaust air is then introduced into the non- hygroscopic segment (S-wheel 3) of the exchanger wheel 1, where its temperature may be further reduced to −18° C. Referring to FIG. 6 it is to be noted that the whole moisture/heat transfer process may occur below the saturation curve 40 for water in air; the humidity curve of the exhaust air is designated with the reference numeral 41 and the humidity curve of the fresh cold air is designated with the reference numeral 42.

FIGS. 7 to 11 illustrate an example embodiment of a box-like exchanger device 50 having two built in separate first and second air path components; this device may be used as a non-rotary type unitary exchanger device. The box-like exchanger device is shown as being rectangular; it could of course take on a different parallelipiped shape (e.g. be of square shape).

Figure 7:
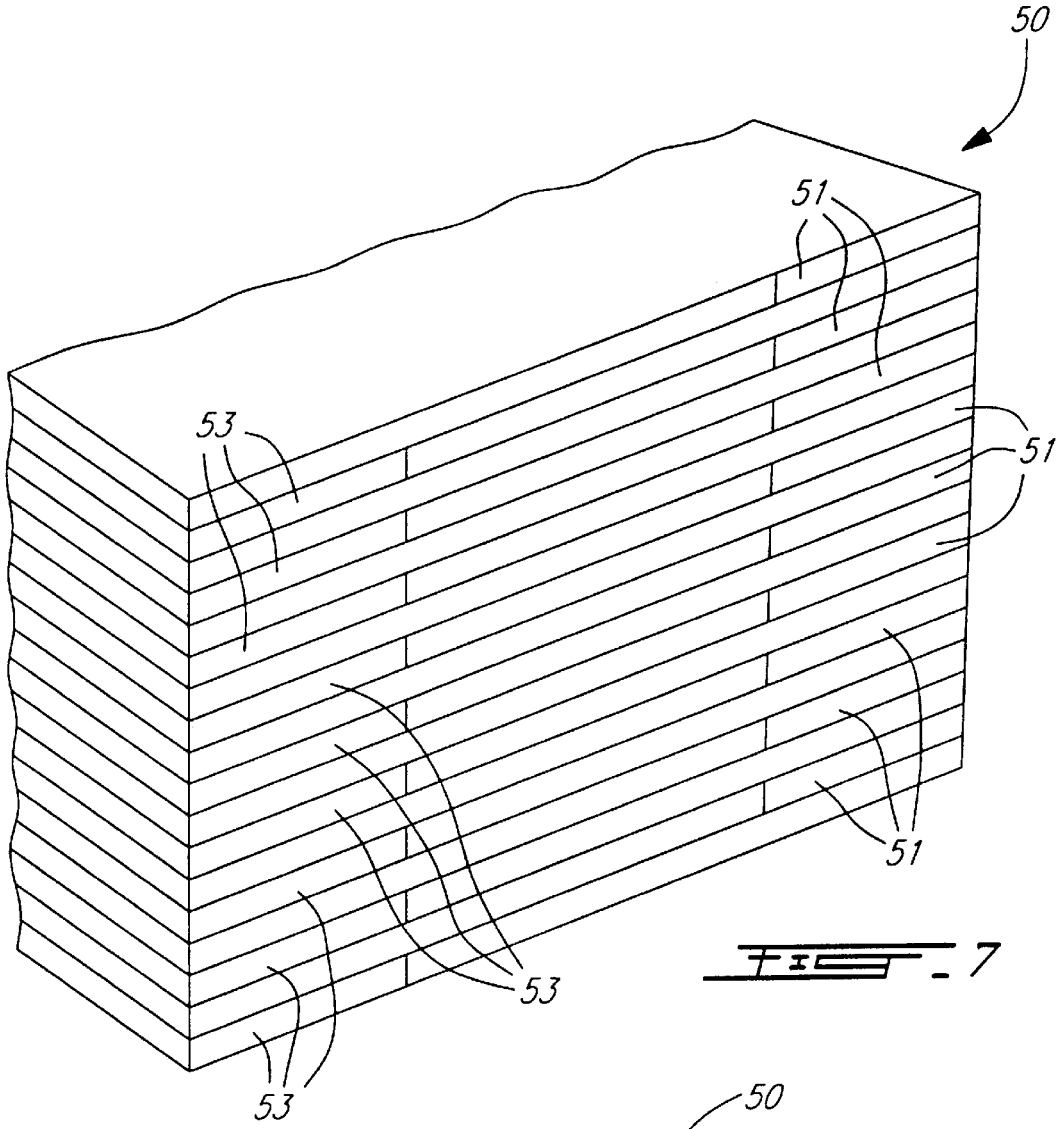
FIG. 7 is a partial perspective side view of another example exchanger device comprising two separate built in air path elements.
Figure 8:
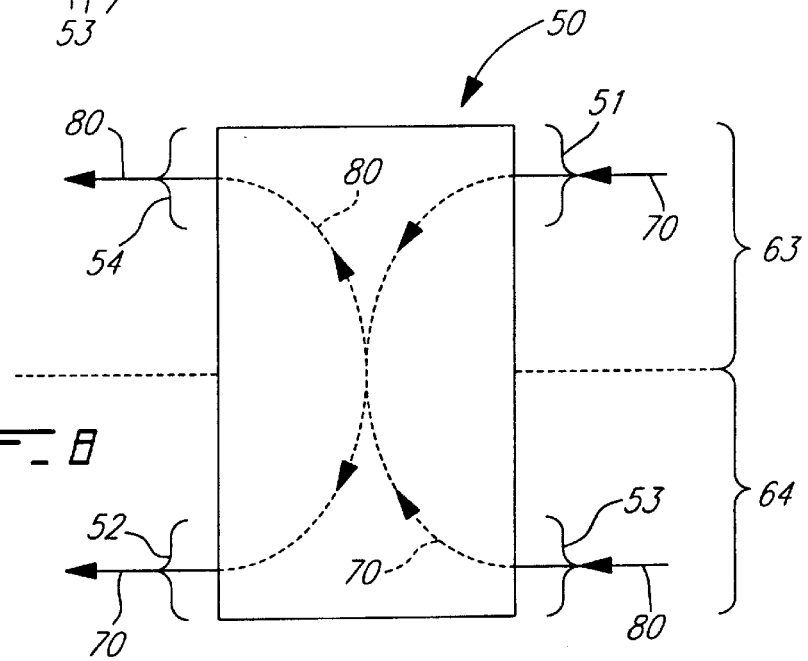
FIG. 8 is a schematic illustration of the air flow streams flowing through the exchanger device shown in FIG. 7.

Each air path component comprises a plurality of layer channels. Referring to FIGS. 7 and 8, the layer channels of the first air path component each have a first inlet 51 and a first outlet 52; the layer channels of the second air path component each have a first inlet 53 and a first outlet 54. The layer channels are disposed in alternating or staggered fashion such that a layer channel of one air path component is spaced apart form another layer channel of the same air path component by a layer channel of the other air path component.

Figure 9:
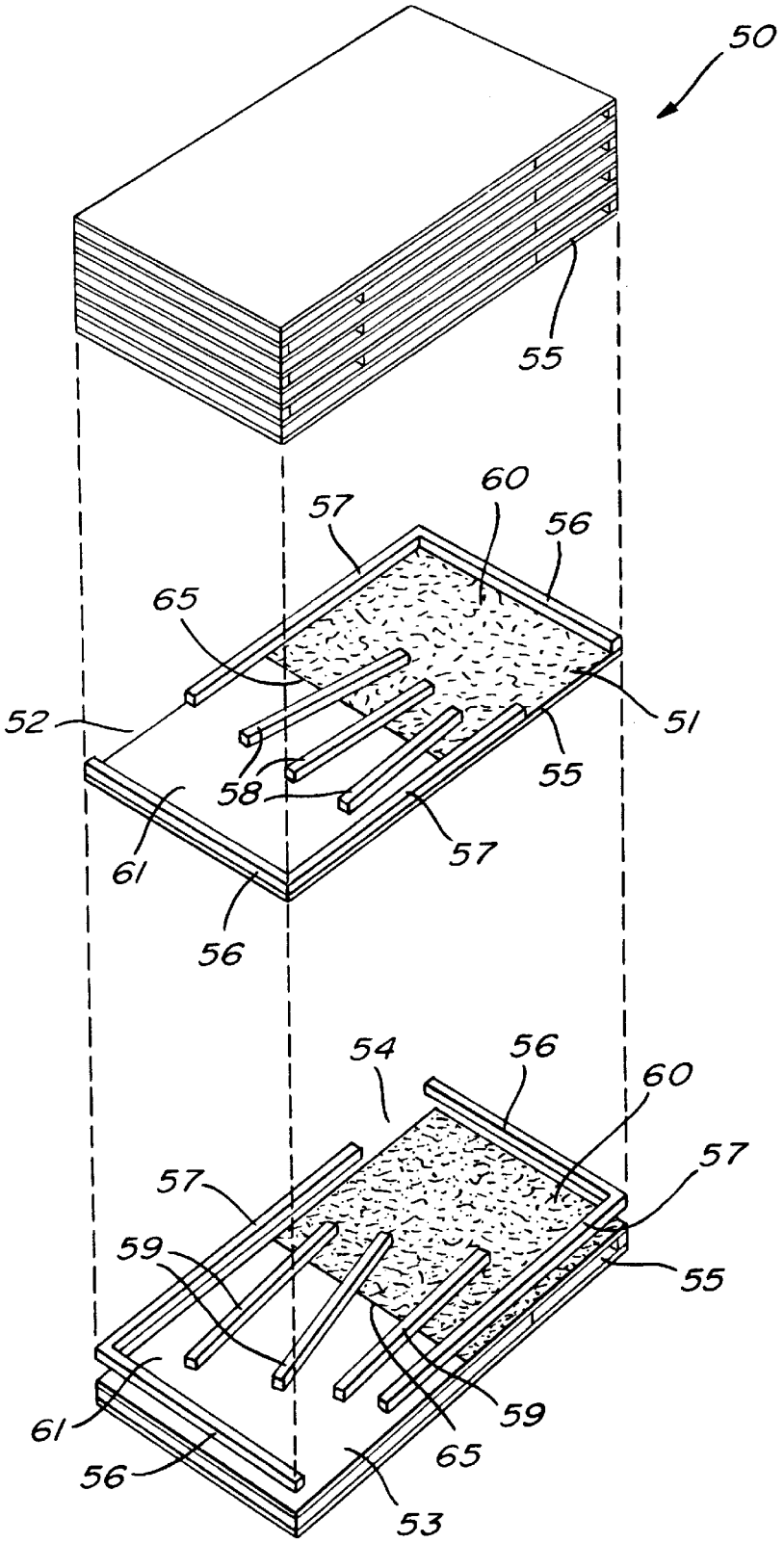
FIG. 9 is a schematic perspective view of the exchanger device of FIG. 7 in the process of being formed from sheets and spacing elements.
Figure 10:
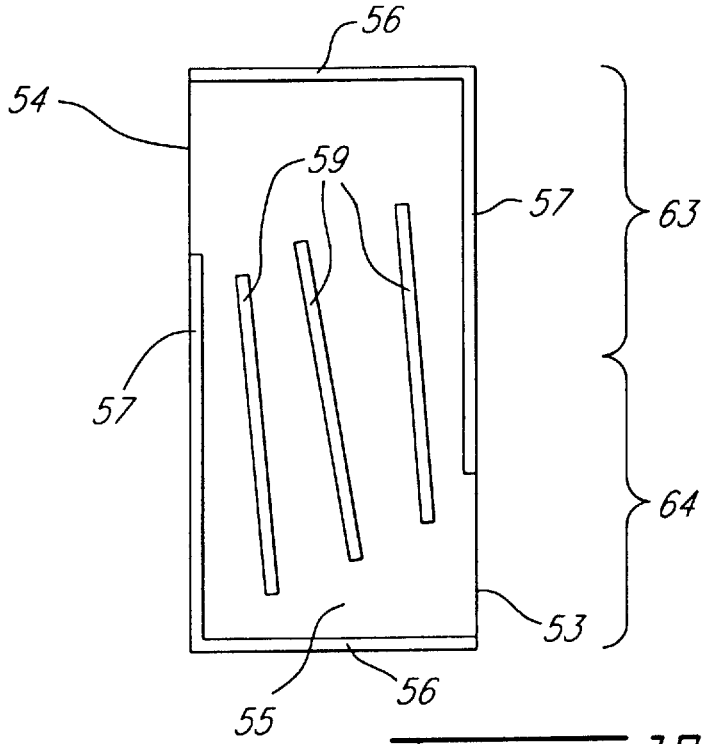
FIG. 10 is a top view of the interior of a channel element of the device of FIG. 7.

As may be seen from FIG. 9, the box-like exchanger device 50 may be built up by stacking a plurality of partition wall members 55 one over the other. The individual partition wall members 55 are spaced apart from each other by a pair of opposed narrow side wall elements 56 and a pair of broad side wall elements 57. The disposition of the broad side wall elements 57 determines whether a channel layer is a member of the first or of the second air path component since the position of the broad side wall elements 57 determines where the inlet and outlet of a particular channel layer is disposed. Thus, the broad side wall elements 57 are each disposed in the alternating channel layers of the first air component such that the broad side wall elements 57 are spaced apart from a corresponding narrow side wall element 56 so as to define a first inlet 51 and first outlet 52 of a channel layer; similarly, the broad side wall elements 57 are each disposed in the alternating layers of the second air component such that the broad side wall elements 57 are spaced apart from a corresponding narrow side wall element 56 so as to define a first inlet 53 and first outlet 54 of a channel layer. Baffle members 58 are disposed in each of layer channels of the first air path component; baffle members 59 are also disposed in each of layer channels of the second air path component. The partition wall members and the side wall elements may be fixed in place relative to each other by any suitable means such as for example an adhesive (e.g. glue).

Figure 11:
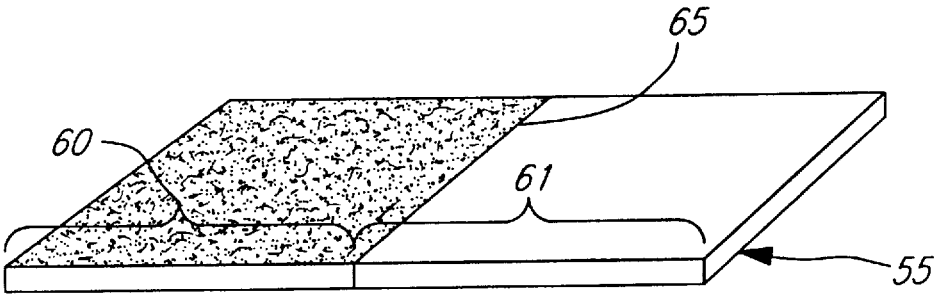
FIG. 11 is a side view of a sheet member used for defining a partitioning or wall element of the device of FIG. 7.

Referring to FIG. 11 each of the partition wall members is divided into an air-to-air water vapor (i.e. moisture) transfer wall segment 60 and an air-to-air sensible heat transfer wall segment 61. The segment 60 may for example be of a suitable water vapor permeable material (e.g. paper) and the segment 61 may be of a suitable material (e.g. a metal, e.g aluminum, copper, etc.) capable of allowing sensible heat to be passed therethrough from one air stream to another air stream. The two wall segments may for example be glued together along seam 65, i.e. so as to among other things, render the seam 65 more or less air tight.

Referring to FIG. 9, the partition wall members 55 are each disposed in the device 50 such that the segments 60 are on the same side of the device, one opposite the other; similarly, the segments 61 are also on the same side of the device, one opposite the other. In this fashion the segments 60 define a moisture transfer wall component and the segments 61 define a sensible heat transfer wall component.

Referring to FIG. 8, the device 50 is thus divided into an air-to-air water vapor transfer segment or part 63 and an air-to-air sensible heat transfer segment or part 64. Air flowing through the first air path component may thus first flow through the water vapor transfer segment 63 and then through the sensible heat transfer segment 64 in the direction of the arrows 70 ; air flowing through the second air path component may on the other hand be made to flow through the sensible heat transfer segment 64 and then through the sensible heat transfer segment 63 in the direction of the arrows 80. The device 50 may in this case be made to operate in a fashion analogous to the operation described above for the device shown in FIG. 1, i.e. below the saturation curve of water in air.

The device 50 may be incorporated into a ventilation system whereby suitable ducting or equivalent means connects the various inlets and outlets for air communication with the interior and exterior structure for the exchange of air.

In the device shown in FIGS. 7 to 11, the inlets and outlets are all shown as being on opposed broad sides of the box-like device. If desired wall members 57 and 58 may, alternatively, be configured and disposed such that the inlets 51 and 53 and outlets 52 and 54 are each disposed on opposed narrow sides of the box-like structure. Other variations are of course possible.

We claim:

1. A unitary air-to-air heat exchanger device comprising an air-to-air water vapor transfer element and an air-to-air sensible heat transfer element, said transfer elements being configured such that air may pass there through, said water vapor transfer element being configured for the capture and release of water vapor from and to air and said sensible heat transfer element being configured for the capture and release of sensible heat from and to air.

2. A unitary air-to-air heat exchanger wheel having a rotational axis and comprising a first air-to-air water vapor transfer wheel segment and a second air-to-air sensible heat transfer wheel segment, said first and second wheel segments each having an axis of rotation coaxial with said rotational axis, said wheel segments being in air communication with each other and being configured such that air may pass there through in a direction along said rotational axis, said water vapor transfer wheel segment being configured for the capture and release of water vapor from and to air, and said sensible heat transfer wheel segment being configured for the capture and release of sensible heat from and to air.

3. An heat exchanger wheel as defined in claim 2 wherein said water vapor transfer wheel segment comprises channels, wherein said sensible heat transfer wheel segment comprises channels, wherein channels of said water vapor transfer wheel segment are in air communication with channels of said sensible heat transfer wheel segment and wherein the channels of said water vapor transfer wheel segment and said sensible heat transfer wheel segment are disposed parallel to said rotational axis.

4. A unitary heat exchanger wheel as defined in claim 2 wherein said heat transfer means consists of said first air-to-air, water vapor transfer wheel segment and said second air-to-air, sensible heat transfer wheel segment.

5. An heat exchanger wheel as defined in claim 4 wherein said water vapor transfer wheel segment comprises channels, wherein said sensible heat transfer wheel segment comprises channels, wherein channels of said water vapor transfer wheel segment are in air communication with channels of said sensible heat transfer wheel segment and wherein the channels of said water vapor transfer wheel segment and said sensible heat transfer wheel segment are disposed parallel to said rotational axis.

* * * * *

UNITED STATES PATENT AND TRADEMARK OFFICE

CERTIFICATE OF CORRECTION

PATENT NO. : 5,771,707

DATED : 6/30/98

INVENTOR(S) : Lagaceet et al.

It is certified that error appears in the above-identified patent and that said Letters Patent is hereby corrected as shown below:

Please add new claims 6 and 7 as follow:

6. A unitary air-to-air heat exchanger device comprising separate first and second air paths configured for the passage of air there through and wall means between said first and second air paths,
said wall means comprising
an air-to-air water vapour transfer wall component,
and
an air-to-air sensible heat transfer wall component,
said water vapour transfer wall component defining a respective portion of said first and second air paths and being configured for the transfer there through of water vapour in air in said first air path to air in the second air path,
said sensible heat transfer wall component defining a respective portion of said first and second air paths and being configured for the transfer there through of sensible heat in air in said first air path to air in the second air path.

UNITED STATES PATENT AND TRADEMARK OFFICE

CERTIFICATE OF CORRECTION

PATENT NO. : 5,771,707

DATED : 6/30/98

INVENTOR(S) : Lagaceet et al.

It is certified that error appears in the above-identified patent and that said Letters Patent is hereby corrected as shown below:

7. A unitary air-to-air heat exchanger device as defined in claim 6 wherein each of said first and second air paths comprises a plurality of separate channels defined by said wall means, said channels being staggered such that each channel of the first air path is spaced apart by a channel of the second air path.

Signed and Sealed this

Ninth Day of February, 1999

*Attest:*

*Attesting Officer*

*Acting Commissioner of Patents and Trademarks*